US008251548B2

(12) United States Patent
Zhang et al.

(10) Patent No.: US 8,251,548 B2
(45) Date of Patent: Aug. 28, 2012

(54) LED MODULE

(75) Inventors: Hai-Wei Zhang, Shenzhen (CN); Jia-Chuan Lv, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 509 days.

(21) Appl. No.: 12/556,585

(22) Filed: Sep. 10, 2009

(65) Prior Publication Data

US 2010/0328941 A1 Dec. 30, 2010

(30) Foreign Application Priority Data

Jun. 30, 2009 (CN) ..... 2009 1 0303879

(51) Int. Cl.
*F21V 5/04* (2006.01)

(52) U.S. Cl. ..... 362/311.02; 362/311.06; 362/311.1

(58) Field of Classification Search ..... 362/244, 362/311.01, 311.02, 311.06, 311.08, 311.09, 362/311.1, 311.14, 326, 335, 97.3, 97.4
See application file for complete search history.

(56) References Cited

U.S. PATENT DOCUMENTS 7,422,347 B2 * 9/2008 Miyairi et al. ..... 362/335
8,007,140 B2 * 8/2011 Zhang ..... 362/311.06

* cited by examiner

*Primary Examiner* — Y My Quach Lee
(74) *Attorney, Agent, or Firm* — Altis Law Group, Inc.

(57) ABSTRACT

An LED module includes an LED and a lens fixed with the LED for refracting light emitted by the LED. The lens has a center axis and a concaved inner face for incidence of the light and an opposite convex outer face for the light refracting out thereof. The lens is symmetric to a first plane and a second plane perpendicularly intersected with the first plane at the center axis. In the first plane, a peak intensity for the LED occurs within 68-78 degrees off the center axis. In the second plane, a peak intensity occurs within 0-22 degrees off the center axis.

13 Claims, 5 Drawing Sheets

LED MODULE

BACKGROUND

1. Technical Field

The present disclosure relates generally to an LED module, and more particularly to an LED module for lighting.

2. Description of Related Art

LED lamp, a solid-state lighting, utilizes LEDs as a source of illumination, providing advantages such as resistance to shock and nearly limitless lifetime under specific conditions. Thus, LED lamps present a cost-effective yet high quality replacement for incandescent and fluorescent lamps.

Known implementations of LED modules in an LED lamp employ lenses for focusing light generated by the LEDs. However, the light pattern provided by such LED modules is substantially round, which is not suitable for illuminating a certain location, such as roadway. There is a need to be able to direct light in the extending direction of the roadway to avoid lighting on neighboring regions such as houses beside the roadway. Apparently, the round light pattern provided by the conventional LED modules can not satisfy such a requirement.

What is need therefore is an LED module which can overcome the above limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
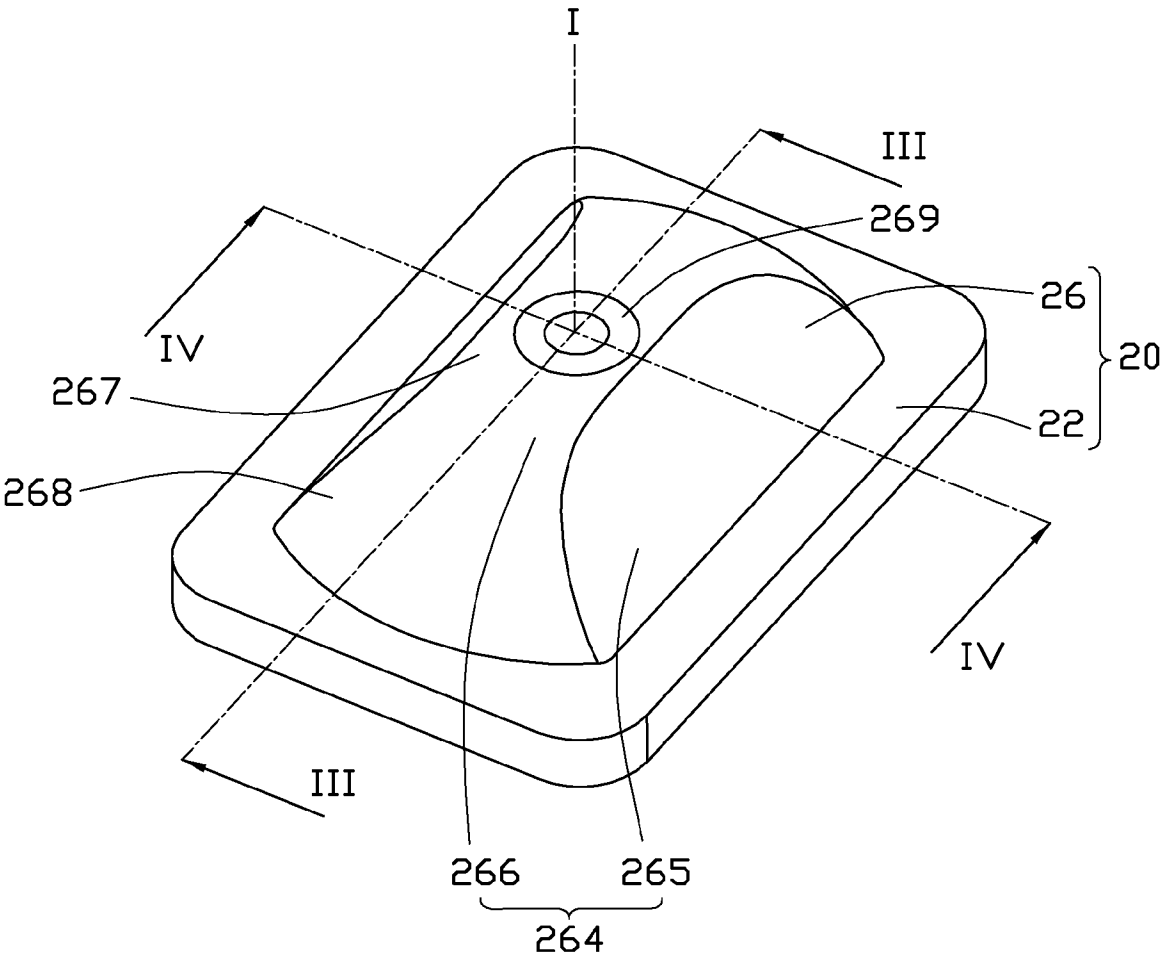
FIG. 1 is an isometric, assembled view of an LED module in accordance with an embodiment of the present disclosure.
Figure 2:
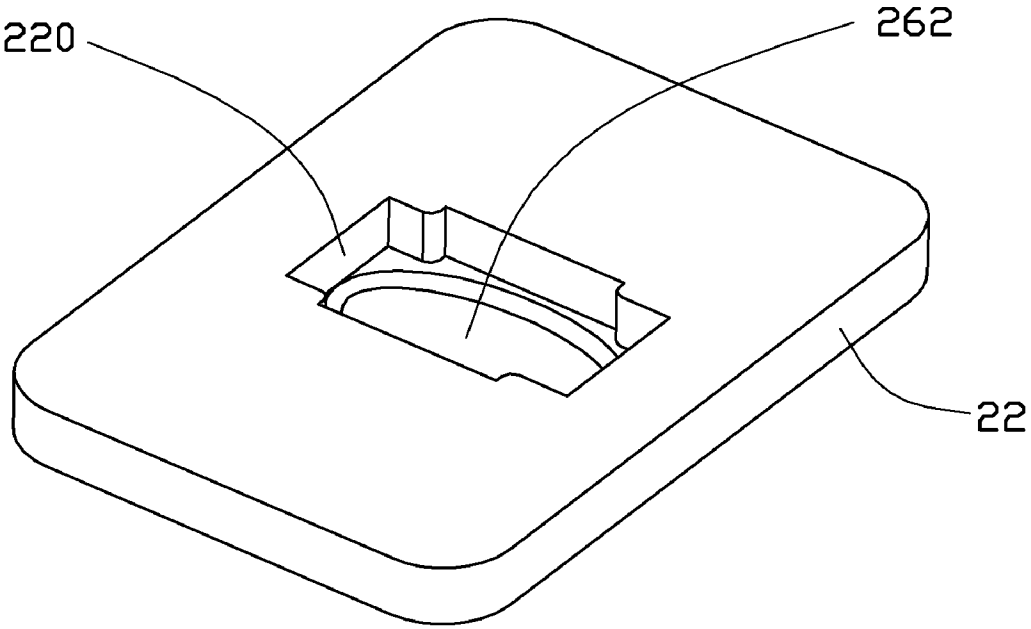
FIG. 2 is an inverted view of the LED module of FIG. 1, with an LED thereof being removed away.
Figure 3:
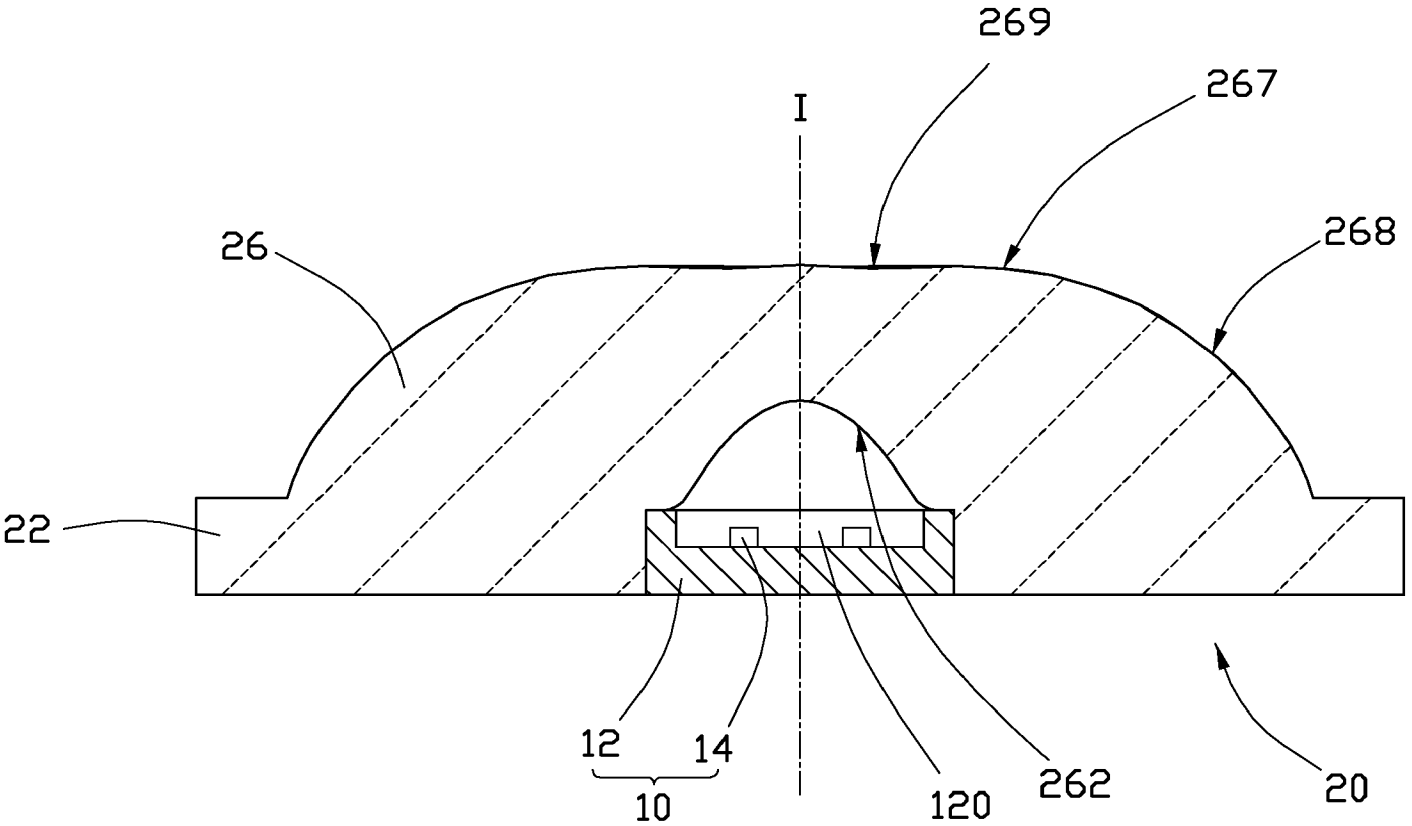
FIG. 3 is a cross-sectional view of the LED module of FIG. 1, taken along line III-III thereof.
Figure 4:
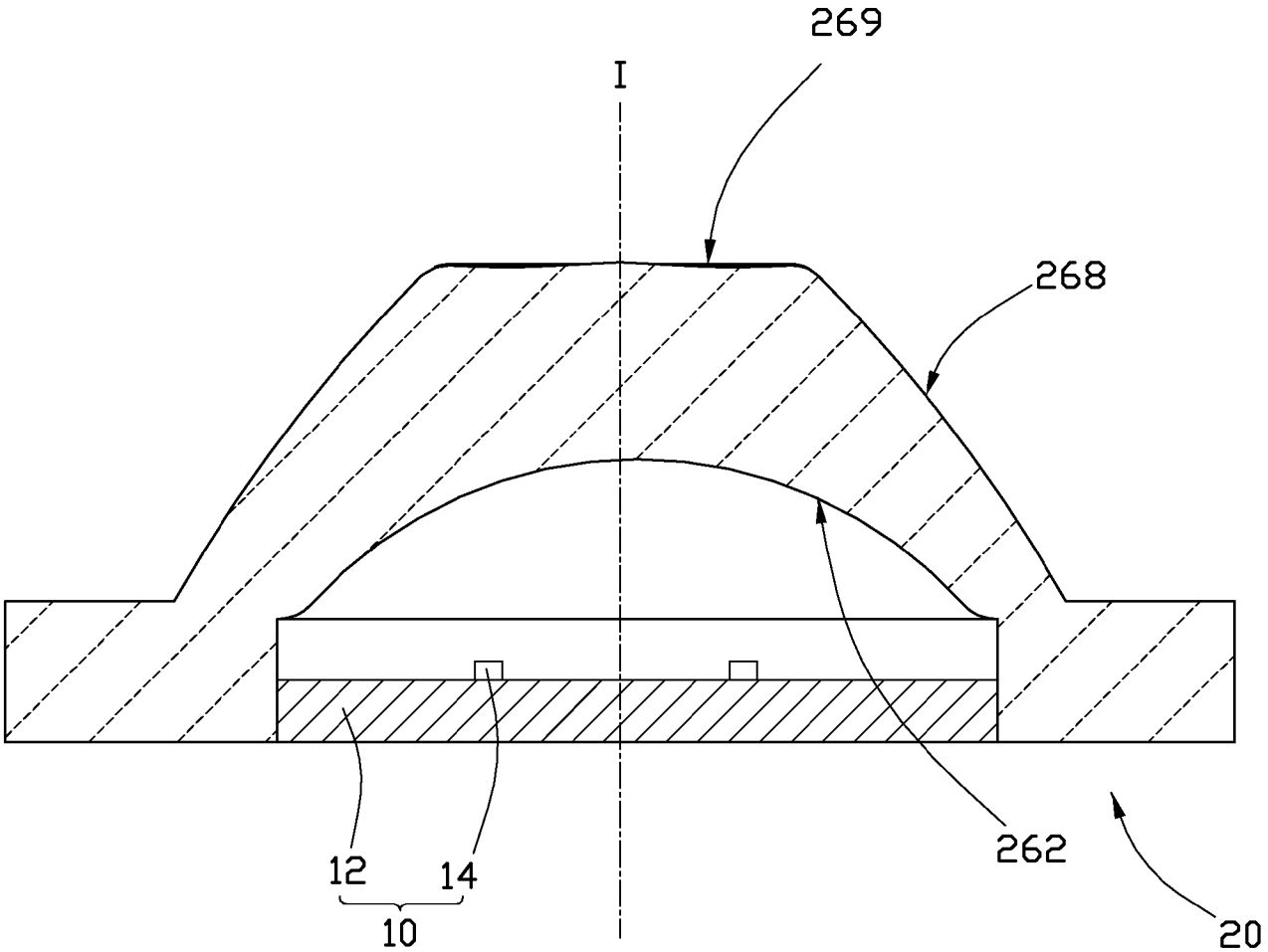
FIG. 4 is an enlarged cross-sectional view of the LED module of FIG. 1, taken along line IV-IV thereof.

FIGS. 1 to 4 illustrate an LED module in accordance with an embodiment of the present disclosure. The LED module comprises an LED 10 and a lens 20 covering the LED 10.

The LED 10 comprises a rectangular base 12 and a plurality of LED chips 14 embedded in a groove 120 defined in a top of the base 12. In this embodiment, two LED chips 14 are shown. The number of the LED chips 14 can be changed corresponding to a desired lighting intensity. It is also understood that more than one LED 10 can be mounted in the lens 20.

The lens 20 is integrally made of a transparent material with good optical performance, such as PMMA or PC. The lens 20 has a center optical axis I and the lens 20 is centrosymmetric relative to the axis I. Further, the lens 20 is symmetric relative to a first plane defined by the axis I and the line III-III, and is symmetric relative to a second plane defined by the axis I and the line IV-IV of FIG. 1. The first and second planes are perpendicularly intersected at the axis I. The lens 20 can be used in a lighting fixture to achieve desired illumination in such as but not limited to, roadway, with the first plane aligned with the elongated direction of the roadway.

The lens 20 comprises a light conducting portion 26 and a frame 22 formed at a bottom of the light conducting portion 26. The frame 22 has flanges extending outwardly and horizontally from the bottom of the light conducting portions 26. An opening 220 is defined in a center of the frame 22 for receiving the LED 10 therein.

The light conducting portion 26 has a concaved inner face 262 exposed to the opening 220 of the frame 22, and an opposite convex outer face 264. The inner face 262 is provided for an incidence of the light generated by the LED 10, and the outer face 264 is provide for refracting the light to achieve a desired illumination performance. The light enters into the inner face 262 and penetrates through the outer face 264, and has no third face to pass through. The inner face 262 is substantially a semi-ellipsoid with a center thereof coincident with the axis I. The minor axis of the ellipsoid is located in the first plane, which is clearly shown in FIG. 3. The major axis of the ellipsoid is located in the second plane, which is clearly shown in FIG. 4. The outer face 264 comprises two first elongated spheroid surfaces 265 inclinedly extending at two sides of the first plane, respectively, and a free surface 266 located between and connecting the two first spheroid surfaces 265. Each spheroid surface 265 is inclined outwardly along a top-to-bottom direction. Bottom sides of the first spheroid surfaces 265 and two end sides of the free surface 266 connect the frame 22. A width of the free surface 266 decreases gradually from two ends to a middle thereof. A width of each first spheroid surface 265 increases gradually from two ends to a middle of the lens 20. The free surface 266 is a compound irregular surface consisted of some different surfaces. In this embodiment, the free surface 266 has an approximation plane 267 located at a middle top thereof and two second spheroid surfaces 268 located at two ends of the approximation plane 267. An annular recess 269 is provided in the approximation plane 267 and centrosymmetric to the axis I for directing the light passing therethrough to radiate at a direction deviating away from the axis I.

Figure 5:
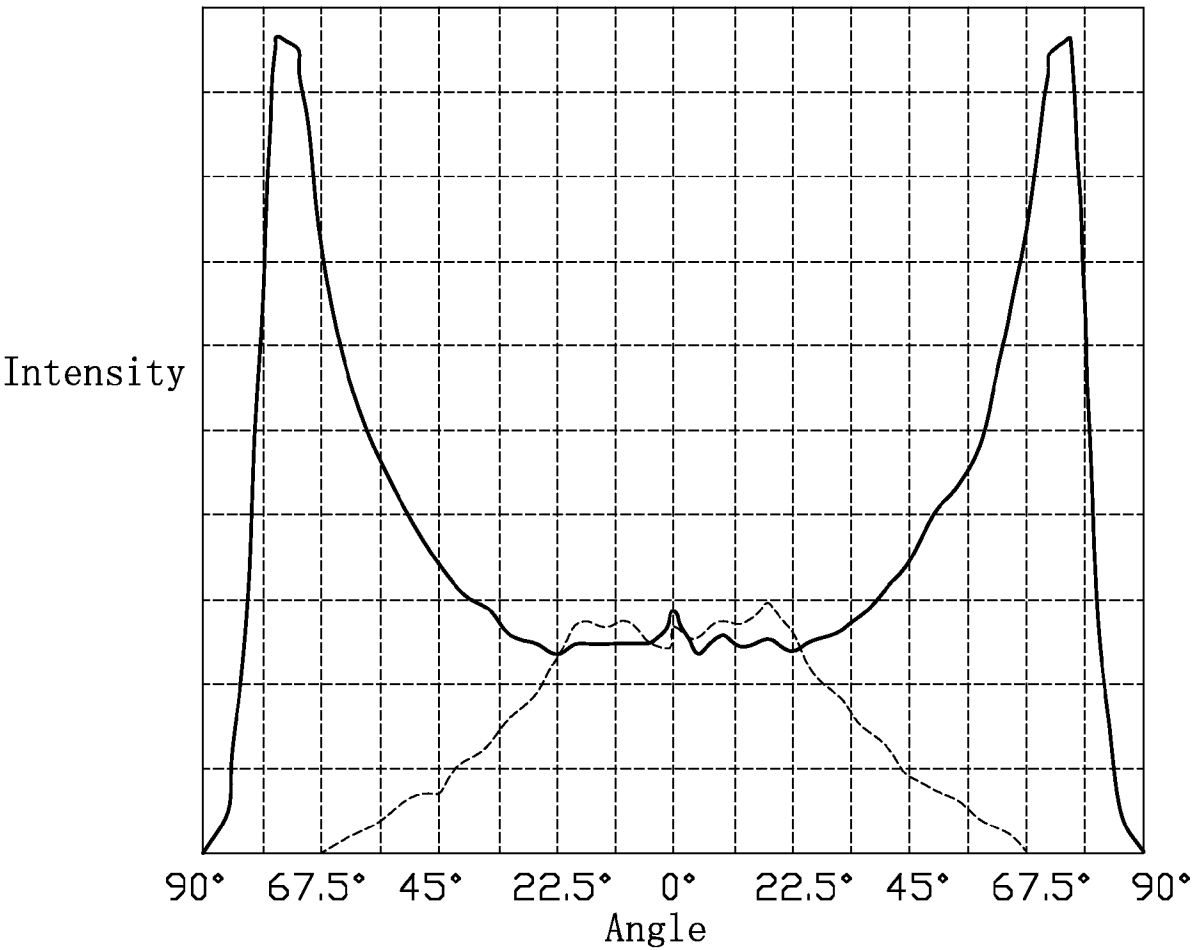
FIG. 5 is a graph of light intensities of the LED module of FIG. 1.

FIG. 5 shows a solid line and a dotted line respectively indicating the light intensities in the first plane and the second plate vs. radiating angles of the LED module. In the first plane, the peak light emission for the LED 10 occurs within 68-78 degrees off the axis I. A range between 71-75 degrees is preferred. The light emission along the axis I is 24%-32% of the peak emission. The brightness within 0-25 degrees off the axis I has no sharp transitions. Half-peak light emission for the LED 10 occurs within 54-58 degrees and 80-82 degrees off the axis I. When the light off the axis I exceeds 75 degree, the light brightness decreases sharply.

In the second plane, the peak light emission for the LED 10 occurs within 0-22 degrees off the axis I. The peak light emission in the second plane is 24%-32% of the peak emission in the first plane, that is, approximate equal to the light emission along the axis I in the first plane. Half-peak light emission in the second plane occurs within 33-40 degrees off the axis I.

As described above, since the half-peak intensity in the first plane occurs at a larger degree than that in the second plane, the brightness profile along the first plane extends a length longer than that extending along the second plane. Thus, a substantially rectangular brightness pattern is obtained, which is preferred to illuminate roadways, hallways, tunnels and so on, with more light in the extending direction thereof, and less or no light on transverse neighboring regions thereof which are not needed to be illuminated by the LED module.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED module comprising:

an LED;

a lens fixed with the LED for refracting light emitted by the LED, the lens having a center axis and a concaved inner face for incidence of the light and an opposite convex outer face for the light refracting out thereof;

wherein the lens is symmetric to a first plane and a second plane respectively, which are perpendicularly intersected at the center axis, and in the first plane, a peak intensity for the LED occurs within 68-78 degrees off the center axis, in the second plane, a peak intensity occurs within 0-22 degrees off the center axis; and wherein the outer face comprises two first spheroid surfaces at two sides of the first plane, respectively, and a free surface located between and connecting the two first spheroid surfaces.

2. The LED module as claimed in claim 1, wherein the peak intensity in the second plane is 24%-32% of the peak intensity in the first plane, and a half-peak intensity in the second plane occurs within 33-40 degrees off the center axis.

3. The LED module as claimed in claim 1, wherein an intensity along the center axis in the first plane is 24%-32% of the peak intensity in the first plane.

4. The LED module as claimed in claim 1, wherein the peak intensity in the first plane occurs within 71-75 degrees off the center axis.

5. The LED module as claimed in claim 4, wherein a half-peak intensity in the first plane occurs within 54-58 degrees and 80-82 degrees off the center axis.

6. The LED module as claimed in claim 4, wherein the light intensity decreases sharply when the light is offset from the center axis in an angle more than 75 degree.

7. The LED module as claimed in claim 1, wherein a width of the free surface decreases from two ends to a middle thereof, and widths of the first spheroid surfaces increase from two ends to a middle thereof.

8. The LED module as claimed in claim 1, wherein the free surface comprises two second spheroid surfaces located at two opposite ends thereof and an approximation plane located at a middle thereof, the center axis defined in a center of the approximation plane.

9. The LED module as claimed in claim 8, wherein an annular recess is defined in the approximation plane and centrosymmetric to the center axis to direct light passing therethrough to a direction away from the center axis.

10. The LED module as claimed in claim 1, wherein the inner face of the lens is a semi-ellipsoid and a minor axis thereof is located in the first plane.

11. An LED module comprising:

at least one LED;

a lens fixed with the at least one LED for refracting light emitted therefrom, the lens having a center axis and a concaved inner face for incidence of the light and an opposite convex outer face for the light refracting out thereof;

wherein the lens is symmetric to a first plane and a second plane perpendicularly intersected with the first plane at the center axis, and in the first plane a peak intensity occurs within 68-78 degrees off the center axis, in the second plane a peak intensity occurs within 0-22 degrees off the center axis, and the peak intensity in the second plane is 24%-32% of the peak intensity in the first plane; and wherein a half-peak intensity in the first plane occurs within 54-58 degrees and 80-82 degrees off the center axis, and a half-peak intensity in the second plane occurs within 33-40 degrees off the center axis; and wherein the outer face comprises two first spheroid surfaces along the first plane and a free surface located between and connecting the two first spheroid surfaces.

12. The LED module as claimed in claim 11, wherein the free surface comprises two second spheroid surfaces located at two opposite ends thereof and an approximation plane located at a middle thereof, the center axis defined in a center of the approximation plane.

13. The LED module as claimed in claim 11, wherein the inner face of the lens is a semi-ellipsoid and the minor axis thereof is located in the first plane.

* * * * *